United States Patent [19]

Miyaki et al.

[11] 4,354,470

[45] Oct. 19, 1982

[54] FUEL SUPPLY APPARATUS IN INTERNAL COMBUSTION ENGINE

[75] Inventors: Kiyoshi Miyaki, Asaka; Akihiro Yamato, Sayama; Hidenobu Nagase, Wako; Kazuo Otsuka, Tanashi, all of Japan

[73] Assignee: Honda Giken Kogyo Kabushiki Kaisha, Tokyo, Japan

[21] Appl. No.: 165,369

[22] Filed: Jul. 2, 1980

[30] Foreign Application Priority Data

Jul. 6, 1979 [JP] Japan ..... 54/85011

[51] Int. Cl.[3] ..... F02M 51/02

[52] U.S. Cl. ..... 123/472; 123/585

[58] Field of Search ..... 123/438, 470, 472, 478

[56] References Cited

U.S. PATENT DOCUMENTS

| | | | |
|---|---|---|---|
| 3,868,936 | 3/1975 | Rivere | 123/445 |
| 3,931,814 | 1/1976 | Rivere | 123/438 |
| 4,159,703 | 7/1979 | Mayer | 123/472 X |
| 4,216,753 | 8/1980 | Inoue et al. | 123/472 X |
| 4,292,945 | 10/1981 | Kiesling | 123/440 X |

*Primary Examiner*—Tony M. Argenbright

*Attorney, Agent, or Firm*—Armstrong, Nikaido, Marmelstein & Kubovcik

[57] ABSTRACT

A fuel supply apparatus in an internal combustion engine in which a venturi provided in the intake passage of the engine is provided with a fuel discharging opening, and the discharge opening is in communication with a fuel-air mixture producing source at which the fuel-air mixture is produced by mixing the external air and the injection fuel injected from a fuel injection nozzle.

4 Claims, 5 Drawing Figures

3
8
7
7a
9
10
11
19
18
6
III 9
10
19
18
6

9
10
20
19
6

9
10
19
θ
18
6

FUEL SUPPLY APPARATUS IN INTERNAL COMBUSTION ENGINE

BACKGROUND OF THE INVENTION

This invention relates to such a type of fuel supply apparatus in an internal combustion for a motorcar or the like that a fuel injection nozzle is used therein.

As an apparatus of this kind, there has been hitherto known such a type one that fuel is injected directly from a fuel injection nozzle into an intake passage which is in communication with a combustion chamber of an internal combustion engine. This type of apparatus, however, has such a drawback that for covering a multiple cylinder engine up to a high speed range it is required that the injection nozzle is in plural number and is of a high responsibility, and thus the apparatus becomes complicated in construction. For removing this drawback, there has been hitherto known such a type of apparatus that a part of the injection fuel is adhered to a pipe in the intake passage so that the adhered fuel is gradually carried and supplied by the air. This type one, however, has still such a drawback that it is difficult to distribute the fuel uniformly to to the multiple cylinders of the engine because the inertia of the fuel flow is differentiated by a driving condition of the engine.

SUMMARY OF THE INVENTION

This invention has for its object to provide an apparatus free from these drawbacks, and it is characterized in that an intake passage which is in communication with a combustion chamber of an internal combustion engine is provided therein with a venturi, and the venturi is provided with at least one fuel discharge opening, and the opening is in communication with a mixture producing source at which a fuel-air mixture is produced by mixing injection fuel from a fuel injection nozzle and the external air.

According to a second feature of this invention, it is characterized in that, in the foregoing apparatus, at least a pair of fuel discharge openings are so disposed as to be in opposite one to another.

According to a third feature of this invention, it is characterized in that, in the foregoing apparatus, the fuel discharge opening is directed to open towards the downstream side of the intake passage.

DESCRIPTION OF THE PREFERRED EMBODIMENTS

Figure 1:
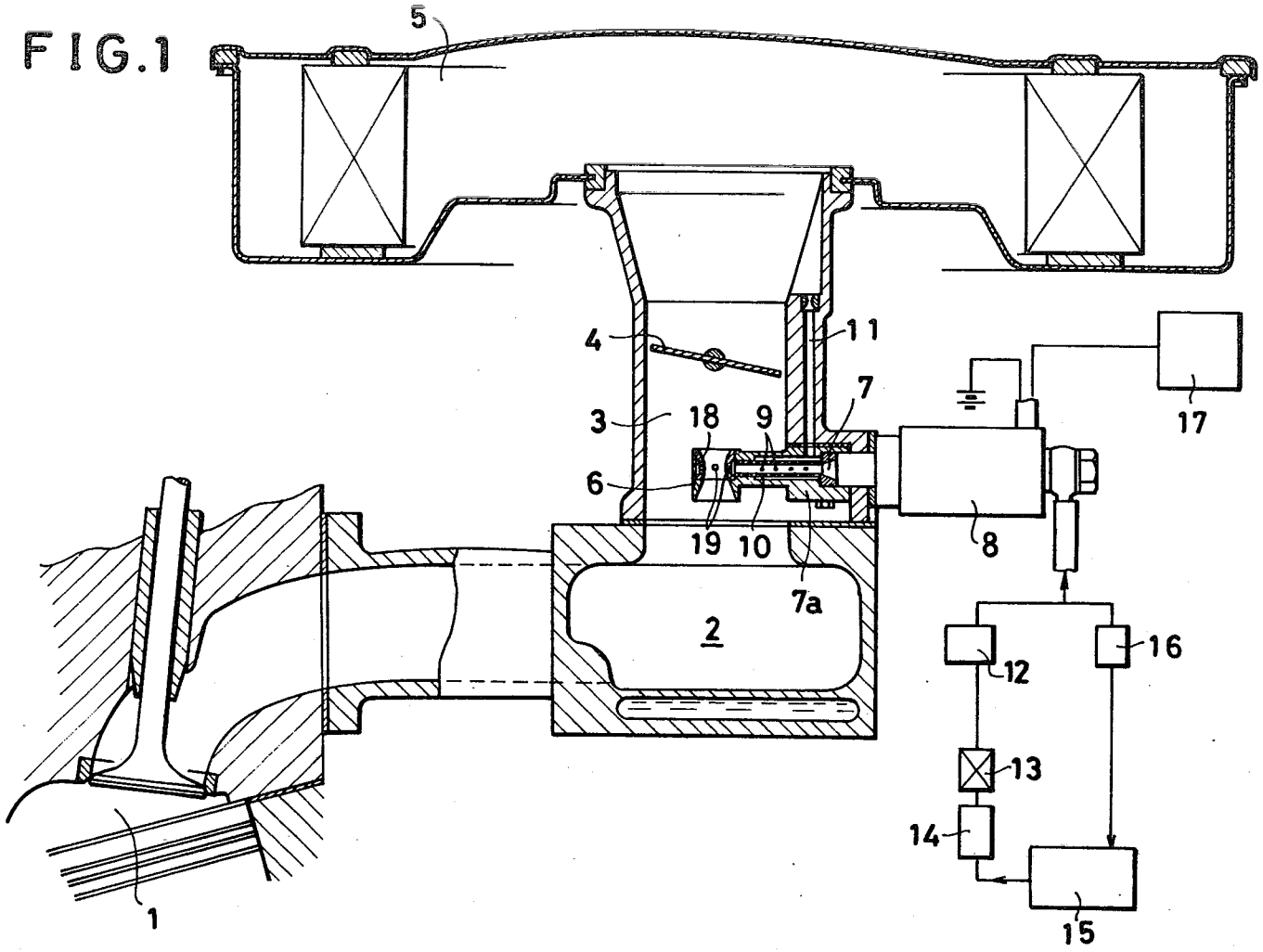
FIG. 1 is a side view, partly in section, of one example of this invention apparatus.
Figure 2:
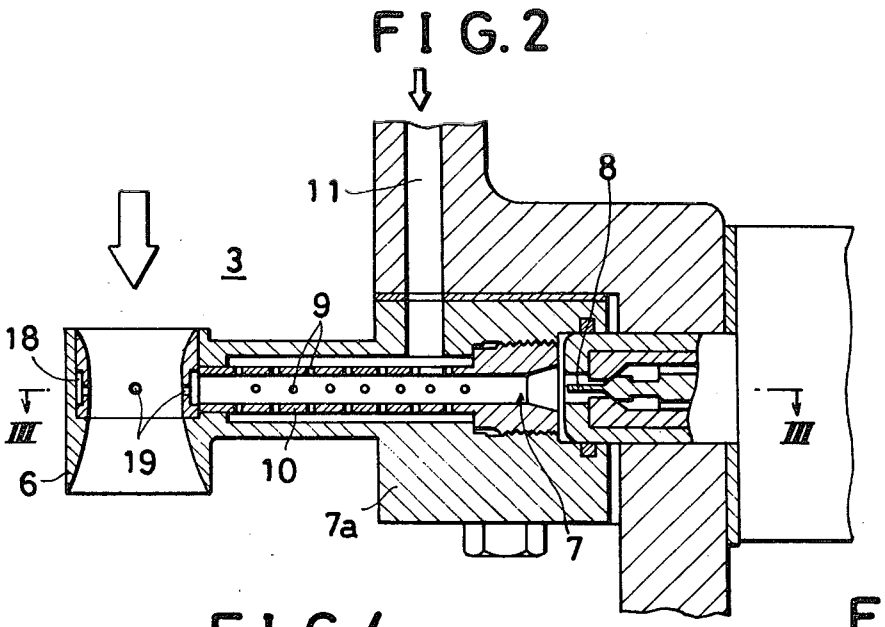
FIG. 2 is an enlarged sectional side view of an important section thereof.
Figure 3:
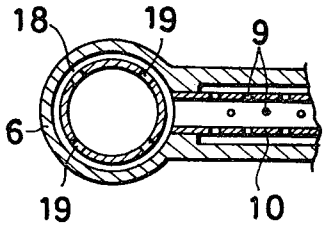
FIG. 3 is a sectional view taken along the line III—III in FIG. 2, and FIGS. 4 and 5 are sectional side views of respective important sections in modified examples.

Embodying examples of this invention wil now be explained with reference to the accompanying drawings:

Referring to FIGS. 1 to 3 showing one example of this invention, numeral 1 denotes a combustion chamber of an internal combustion engine of multiple cylinder type, numeral 2 denotes a mixture distributing chamber which is in communication with the chamber 1, numeral 3 denotes an intake passage, numeral 4 denotes a throttle valve interposed in the intake passage 3, and numeral 5 denotes an air cleaner provided on the upstream side of the throttle valve 4.

The intake passage 3 is provided therein with a venturi 6 located downstream of the throttle valve 4, and the venturi 6 is provided with at least one fuel discharge opening 19. The opening 19 is in communication with a mixture producing source 7 provided on a radially outward side of the venturi 6. The mixture producing source 7 is so arranged that a fuel-air mixture is produced by mixing injection fuel from the injection nozzle 8 and the external air so that the fuel may be introduced into the venturi 6 in the fuel-air mixture state.

More in detail, the mixture producing source 7 comprises a main body *7a*, a bleed tube 10, which is inserted through the main body *7a* and has on its periphery a large number of bleed holes 9, and the fuel injection nozzle 8 disposed to open to the base end of the bleed tube 10, and an annular space surrounding the periphery of the tube 10 is arranged to be supplied with the external air through a secondary air port 11. The nozzle 8 is arranged to be supplied with fuel from a fuel tank 15 through a fuel pump 14, a filter 13 and an accumulator 12.

Referring to the drawings, numeral 16 denotes a regulator means and numeral 17 denotes a control means for controlling the operation of the nozzle 8, that is, opening and closing of the nozzle 8.

The downstream side of the producing source 7 is in communication with the interior space of the venturi 6 through an annular passage 18 made in the outer peripheral surface of the venturi 6, and the plural number of the fuel discharge opening 19 which are radially directional holes made in the inner periphery of the venturi 6.

Where two or more openings 19 are provided, it is preferable that those are so arranged as to be in opposite one to another as shown clearly in FIG. 3. With this arrangement, the fuel-air mixture flows from these openings 19 come together to impinge one another for being drawn downwards from the center, so that the atomization of the fuel can be improved.

The operation of the apparatus will be explained as follows:

If the fuel injection nozzle 8 is operated, the fuel is injected into the bleed tube 10 ahead thereof and the injection fuel mixed with the external air, so that a fuel-air mixture is produced in the tube 10, and the mixture thus produced is then drawn to be introduce into the interior space of the venturi 6 by a negative intake pressure generated in that space, and consequently the mixture is encountered with the intake air for being improved in atomization and dispersion of fuel and is supplied into the combustion chamber 1. For this operation, the injection nozzle 8 is not always required to have a function as a spray valve, and is sufficient to have a function as a metering valve, and accordingly, it is possible that the nozzle 8 is simplified in construction and the fuel pump 14 is sufficient with a low pressure pump.

In general, a conventional engine has such a tendency that an intake negative pressure in a downstream region of the intake passage 3 is varied with any change in speed, stroke an others of the engine and consequently the fuel mixture down the throttle valve is pushed back by the varied pressure and is adhered to the passage wall and others, and thereafter when the negative pressure in the downstream region is increased at the time of deceleration, the adhered fuel is drawn to be flown into the combustion chamber, so that the fuel-air ratio is largely changed.

Figure 5:
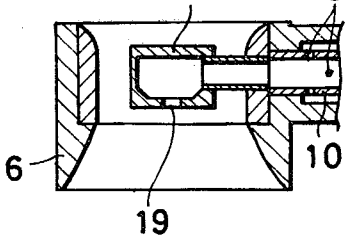
Figure 4:
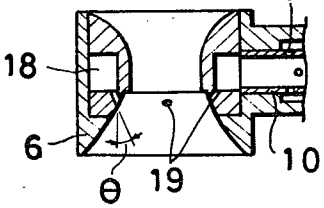

For removing this drawback, it is preferable that the fuel discharge opening 19 is directed to open towards the downstream side of the intake passage 3 as shown, for instance, in FIGS. 4 and 5.

In the example shown in FIG. 4, the discharge openings 19 are so formed into ones extending obliquely downwards from the lower edge of the annular passage 18. In this case, an angle $\theta$ thereof is within a range from 0 degrees to 45 degrees. In the example shown in FIG. 5, a circular frame casing 20 extending from the producing source 7 is provided in the interior space of the venturi 6, and the opening 19 is made in the bottom wall thereof.

Thus, the mixture is discharged from the opening 19 towards the downstream region, and thereby prevention against the pushing back of the mixture can be effected.

Thus, according to this invention, the injection fuel from the fuel injection nozzle is formed into a mixture produced by being mixed with the external air, and thereafter the mixture is introduced into the venturi provided in the intake passage so as to be mixed with the intake air, so that the foregoing defects with the conventional type apparatus can be removed, and it is possible that the nozzle is simple in construction and the fuel pump is a low pressure one. According to the second feature of this invention, the discharge openings are disposed to be in opposite one to another, so that the mixture flows are impinged one another, so that the same can be further improved in atomization. According to the third feature of this invention, the discharge opening is directed to open towards the downstream side, so that prevention against the pushing back of the mixture can be effected.

What is claimed is:

1. A fuel supply apparatus in an internal combustion engine comprising an intake passage having a straight pipe portion with a central axis, a single venturi device positioned and supported in said straight pipe portion along said central axis having a venturi throat therein and at least one fuel discharge opening for discharging into said throat, a mixture producing source communicating with the at least one fuel discharge opening and comprising a hollow bleed tube having two ends and a plurality of bleed holes therethrough positioned circumferentially and axially, one end of the tube opening to the at least one discharge opening, a fuel injection nozzle positioned at the other end of the bleed tube remote from said venturi device, and means surrounding the bleed tube defining an annular space for communicating external air to said plurality of bleed holes whereby a fuel/air mixture produced in said bleed tube by the mixing of fuel supplied under pressure from said injection nozzle with external air passed through the plurality of bleed holes is discharged into said throat of said venturi device through said at least one discharge opening.

2. A fuel supply apparatus as claimed in claim 1, wherein at least a pair of fuel discharge openings are so arranged as to be in opposite one to another.

3. A fuel supply apparatus as claimed in claim 1, wherein the at least one fuel discharge opening is directed to open towards the downstream side of the intake passage.

4. A fuel supply apparatus as claimed in claim 1 wherein only a single fuel discharge opening is provided aligned along said central axis facing directly downstream of said venturi device.

* * * * *